United States Patent [19]

Müller

[11] 4,009,840

[45] Mar. 1, 1977

[54] BLAST NOZZLE FOR ROTATING TEXTILE COILS

[75] Inventor: Herbert Müller, Monchen-Gladbach, Germany

[73] Assignee: W. Schlafhorst & Co., Monchen-Gladbach, Germany

[22] Filed: May 13, 1975

[21] Appl. No.: 577,115

[30] Foreign Application Priority Data

May 15, 1974 Germany ..... 2423493

[52] U.S. Cl. ..... 242/35.6 E

[51] Int. Cl.² ..... B65H 54/22

[58] Field of Search ..... 242/35.6 E, 35.6 R, 242/35.5 R, 18 R

[56] References Cited

UNITED STATES PATENTS 3,464,640 9/1969 Kupper ..... 242/35.6 E

*Primary Examiner*—Stanley N. Gilreath
*Attorney, Agent, or Firm*—Herbert L. Lerner

[57] ABSTRACT

Blast nozzle assembly for pneumatically loosening thread ends of rotating textile coils includes a blast nozzle, means for transporting a textile coil past the blast nozzle in a given travel direction, and means mounting the nozzle for pivoting the same within a limited angular range in and opposite to the given travel direction of the textile coil.

5 Claims, 5 Drawing Figures

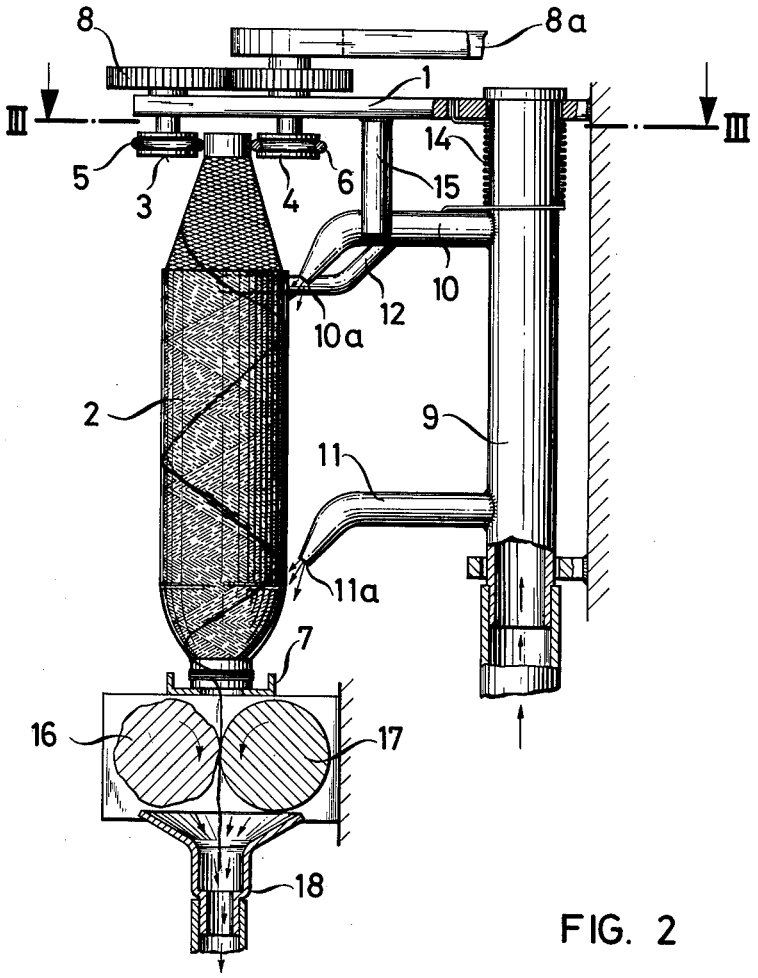
FIG. 1
FIG. 2
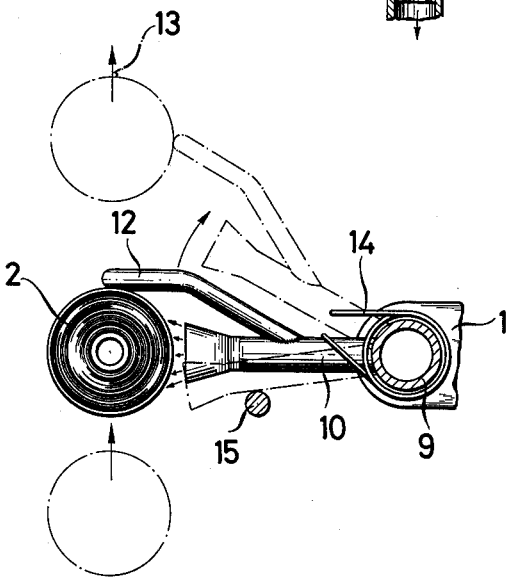
FIG. 3
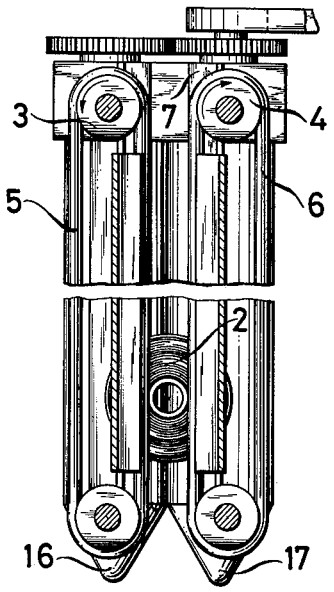

BLAST NOZZLE FOR ROTATING TEXTILE COILS

The invention relates to a blast or blow nozzle assembly for pneumatically loosening thread ends of rotating textile coils, such as cops, especially, which are mounted so as to be transportable past a blast nozzle.

In the series arrangements or production-line installations of blast nozzle assemblies of this general type that are employed at the present time, stationary blast nozzles are installed which have the function initially of loosening the thread windings located on the surface of the coil and then freeing or exposing the end of the thread. The exposed thread then frequently comes into the effective operating range of collecting or intercepting boxes or unwinding rollers. Under these conditions of the blast nozzle assemblies heretofore known in the art, the make-ready time is relatively long, because the duration of the application of the blowing air current to the individual coils is often insufficient when the coil is transported only once past the stationary blast nozzle. It can even be necessary to subject the coil a second time to the action of the blast nozzle.

It is accordingly an object of the invention to provide a blast nozzle assembly which avoids the foregoing disadvantages of the heretofore known assemblies of this general type and which increases the efficiency of the blast nozzle so that the movement of the thread necessary to complete an uninterrupted course of operation is assured.

With the foregoing and other objects in view, there is provided, in accordance with the invention, blast nozzles that are mounted so as to be pivotable horizontally within a limited angular range, and the pivoting movement of the blast nozzles are forcibly controllable by the textile coil or cop per se by the means for transporting the same. More specifically, there is provided in accordance with the invention, a blast nozzle assembly for pneumatically loosening thread ends of rotating textile coils comprising a blast nozzle, means for transporting a textile coil past the blast nozzle in a given travel direction, and means mounting the nozzle for pivoting the same within a limited angular range in and opposite to the given travel direction of the textile coil.

In accordance with another feature of the invention, means are further provided for forcibly controlling the pivoting of the nozzle-mounting means in accordance with the travel of part of the textile coil-transporting means past the blast nozzle.

In accordance with a further feature of the invention, entrainer means are provided extending from the blast nozzle and engageable by the textile coil as the latter is transported by the part of the transporting means over a given distance corresponding substantially to the limited angular range. In accordance with more specific features of the invention the transporting means carries the textile coil in substantially vertical position as it is transported in the given travel direction, and the entrainer means comprises a substantially rod-shaped entrainer member.

Through a pivotable nozzle entrained in this manner, not only will the textile coils or cops remain for a longer period in the air current produced by the blast nozzle, but also a larger peripheral sector thereof is subjected to the pneumatic action of the nozzle. A considerably greater quantity of air would be required with a stationary nozzle for a simultaneously longer period of blowing or blasting of the nozzle, in order in fact, to obtain the same effect or action.

It is also an additional feature of the invention to provide the transporting means with a suitable extension or the like by which, in light of the textile coil per se, the entrainer means is engageable, as a part of the transporting means transports the textile coil over a given distance corresponding substantially to the limited angular range.

Finally, there is provided, in accordance with an alternate feature of the inventnion, a construction of the blast nozzle assembly wherein the blast nozzle receives the pivoting movement thereof independently of the movement of the textile coil or cop. Thus, the pivoting movement may be effected by an independent actuating source of any desired type.

Other features which are considered as characteristic for the invention are set forth in the appended claims.

Although the invention is illustrated and described herein as embodied in a blast-nozzle for rotating textile coils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a side elevational view partly in section of a pivotally mounted blast nozzle assembly constructed in accordance with the invention;

FIG. 2 is a top plan view of a part of FIG. 1;

FIG. 3, is a cross-sectional view of FIG. 1 taken along the line III—III therein in the direction of the arrows.

Figure 4:
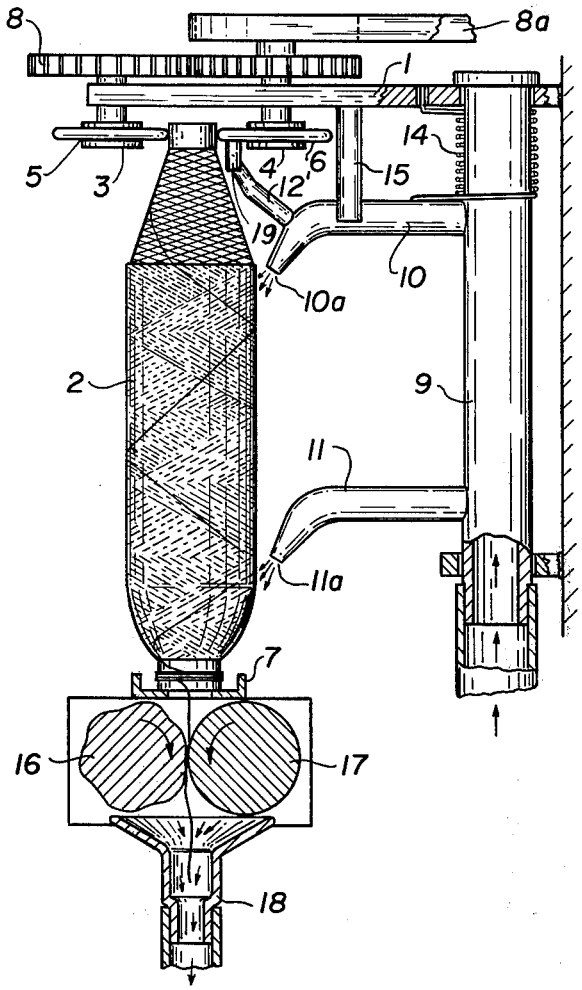
FIG. 4 is a view similar to that of FIG. 1 of another embodiment of the invention.

Referring now to the drawing and particularly to FIG. 1 thereof there is shown a wall arm 1 extending from a rigid vertical support. One of a plurality of cops 2 is shown being advanced or transported in direction perpendicular to the plane of the drawing through an endless drive or conveyor in the form of belts 5 and 6 which run around sheaves or rollers 3 and 4, the cop 2 being assured trouble-free guidance by a lower guide rail 7. A toothed belt 8*a*, for example, provides the power which is transmitted by a gear transmission 8, to the rollers 3 and 4. An air guidance tube 9 having substantially horizontal blast nozzles 10 and 11 extending therefrom is disposed substantially parallel to the axis of the substantially vertically-supported cop 2. The blast nozzles 10 and 11 have terminal portions 10*a* and 11*a* that are provided with a downward inclination or angle so that the blast of air therefrom will impinge with the fullest possible effect upon the thread winding of the cop 2. An entrainer member 12 having twice-angled or inclined portions is rigidly secured to the upper blast nozzle 10 and is entrained by the cop 2 as the latter is carried in direction of the arrow 13, as shown in FIG. 3, by the transporting device 3, 4, 5, 6.

As further shown more clearly in the top plan view of FIG. 3, the entrainer member 12, together with the nozzles 10 and 11, which are rigidly secured to the pivotable air guidance tube 9, is entrained by the cop 2 until the entrainer member 12, as shown in broken lines in FIG. 3, slides off the thread windings of the cop 2 and swings back to come into contact with the next-followig cop. This process is repeated cyclically. A torsion spring 14 mounted on the air guidance tube 9 and having one end thereof secured to the wall arm 1, and the other end thereof suitably engaging the blast nozzle 10, as shown in FIGS. 1 and 3, provides for the automatic return of the entrainer member 12. A pin 15 secured to and extending downwardly from the wall arm 1, as shown in FIGS. 1 and 2, limits the return stroke of the entrainer member 12.

The exposed thread end, as is readily apparent in FIG. 1, is blown downwardly, seized by counter-rotating rollers 16 and 17 and pneumatically advanced through a funnel 18. Only the roller 17 of the two counter-rotating rollers is circular, the other roller 16 having an irregular polygonal shape. Through this particular construction or measure, the thread or yarn passing through the nip between the rollers 16 and 17 is intermittently unwound from the cop 2, thereby minimizing the danger of thread or yarn breakage. Remainder or residue air from that blown through the blast nozzles 10 and 11 continues to maintain an air current or flow below the rollers 16 and 17. If necessary, the funnel 18 can be connected to a non-illustrated suction line to provide adequate air flow through the funnel 18. A particular advantage of the device of the instant application over corresponding devices known in the prior art is that the surfaces of the cops, in the invention of the instant application, remain subjected to a completely effective air current over a longer period than are the prior art devices. The likelihood that the thread end will be found and loosened from the surface of the coil is thereby considerably increased.

From FIG. 4, it is readily apparent that the entrainer member 12' can be suitably constructed in accordance with the invention so as to engage a projection 19 from the endless belts 5 or 6 so that the blast nozzles 10 and 11 may be suitably pivoted by direct contact wih the endless belt projection instead of with the cop 2.

It is claimed:

1. Blast nozzle assembly for pneumatically loosening thread ends of rotating textile coils comprising a blast nozzle, means for transporting a textile coil past said blast nozzle in a given travel direction, means for pivotally mounting said nozzle, and means for controlling pivoting movement of said nozzle in accordance with the travel of the textile coil within a limited angular range in and opposite to the given travel direction of the textile coil.

2. Blast nozzle assembly for pneumatically loosening thread ends of rotating textile coils comprising a blast nozzle, means for transporting a textile coil past said blast nozzle in a given travel direction, means mounting said nozzle for pivoting the same within a limited angular range in and opposite to the given travel direction of the textile coil and means for forcibly controlling the pivoting of said nozzle-mounting means in accordance with the travel of part of said textile coil-transporting means past said blast nozzle.

3. Blast nozzle assembly according to claim 2 including entrainer means extending from said blast nozzle and engageable by the textile coil as the latter is transported by said part of said transporting means over a given distance corresponding substantially to said limited angular range.

4. Blast nozzle assembly according to claim 2 including entrainer means extending from said blast nozzle and engageable by said transporting means as a part thereof transports the textile coil over a given distance corresponding substantially to said limited angular range.

5. Blast nozzle assembly according to claim 2 wherein said transporting means carries the textile coil in substantially vertical position as it is transported in said given travel direction and including a substantially rod-shaped entrainer member extending from said blast nozzle and engageable by the substantially vertical coil as the coil is transported by said part of said transporting means over a given distance corresponding substantially to said limited angular range.

* * * * *